United States Patent [19]

Goedhart et al.

[11] 4,378,547

[45] Mar. 29, 1983

[54] ELECTROMAGNET

[75] Inventors: Arnoldus Goedhart, Velsen-Zuid; Bernard van Rijn, IJmuiden; Jan-Hendrik de Visser, Driehuis, all of Netherlands

[73] Assignee: Estel Hoogovens B.V., IJmuiden, Netherlands

[21] Appl. No.: 188,071

[22] Filed: Sep. 17, 1980

[30] Foreign Application Priority Data

Sep. 21, 1979 [NL] Netherlands ..... 7907029

[51] Int. Cl.[3] ..... H01F 7/20

[52] U.S. Cl. ..... 335/291; 335/286; 335/297; 294/65.5; 414/781

[58] Field of Search ..... 335/289, 291, 295, 297, 335/286, 287, 296; 294/65.5; 414/758, 768, 770, 780, 781

[56] References Cited

U.S. PATENT DOCUMENTS 4,162,471 7/1979 Peace et al. ..... 335/291

*Primary Examiner*—Stafford D. Schreyer

*Attorney, Agent, or Firm*—Jon Lewis

[57] ABSTRACT

When an electromagnet (2) is employed to lift and turn a slab of steel, there is a risk that the slab is dropped, causing undesirable noise. Also, with a flat contact surface of the electromagnet, there is jerking of the apparatus. Improvement in both respects is achieved by the use of a singly curved convex contact surface (7) of the electromagnet, which provides line contact with the slab at all times, avoiding transitions from line contact to face contact.

8 Claims, 12 Drawing Figures

1
2
3
4
5
6
7
8
9
10

ELECTROMAGNET

BACKGROUND OF INVENTION

1. Field of the Invention

The invention relates to electromagnetic apparatus for turning and/or lifting a slab of steel or other ferromagnetic material, and to a method of lifting and/or turning such a slab.

2. Description of Prior Art

Steel slabs are semi-finished products obtained in the steel industry by slab rolling or continuous casting. A slab may, for example, measure 12,000×2,000×225 mm, and weigh about 40 metric tons. The slabs are checked before further processing for inter alia surface flaws, such as tears. These flaws are removed by so-called "scarfing" with the aid of an oxygen burner. The slabs must be turned during checking and scarfing. By "turning" in this context is meant that the slab lying on the ground is turned with for example one of its longer sides used as the axis of turn, in such a way that the surface originally underneath comes to face upwardly. This is performed by means of an installation such as a crane (commonly a semi-gantry crane) equipped with a traversing trolley with an electromagnet. Known magnets used for this purpose are provided with a flat lifting surface.

A problem arising in turning a slab with a known magnet of this kind will be explained in the description with reference to the Figures. Briefly, contact between a slab and the electromagnet during turning is often interrupted, so that the slab falls to the ground. The booming sound that this produces is a nuisance not only to those working in the factory but also for nearby residents, particularly during the night. Another problem when turning a slab with the known kind of magnet is that jerking of the apparatus occurs, which leads to wear and other operative damage to the installation.

Several solutions of this problem are proposed in the prior art, but all involve the use of a plurality of magnets articulatedly connected to each other by bent arms. The magnets have flat faces to engage the slab and, by reason of their articulated connection, can engage both the opposite faces of the slab. See for example German Offenlegungsschrift Nos. 2,115,847 and 2,720,769 and U.K. Pat. Specification No. 1,421,762. Such an arrangement is excessively complex and difficult to put into practical operation.

SUMMARY OF THE INVENTION

The object of the invention is therefore to provide a method and apparatus for lifting and/or turning a steel slab which reduces or avoids the risk that the lifted slab falls off the electromagnet and also reduces jerking of the apparatus during turning.

This is achieved in that the surface of the magnet which is in contact with the slab during turning, has a single convex curved shape, as defined in the claims.

The surface of this shape is straight in one direction and curved in the other direction with the centre points line or lines of the curvature lying to one side of the lifting surface, i.e. at the "interior" side as seen from inside the magnet. A cylindrical surface is an example of such a shape, but other convex shapes are possible and may be preferable.

With this shape there is line contact between the lifting surface and the slab during turning. Transitions from line contact to face contact are avoided. With transitions from line contact to face contact in the prior art arrangement of FIGS. 1 to 6, it is a very common occurence that the 'line contact' is disconnected during the transition momentarily, and the slab is let loose to be dropped on to the floor, thus wasting processing time and causing undesirable jerk and noise. The advantage of the cylindrical shape of the lifting surface is that the slab no longer falls to the ground and that no jerking of the installation occurs.

A useful construction of the magnet is obtained if it has a removable shoe whose undersurface is of the single convex curved shape. This shoe can be quickly exchanged if damaged or worn without the whole magnet having to be replaced.

In practice, one or more socalled E or U magnets may be used. In this case, all poles are provided with a removable shoe.

It has been found that, to achieve technically and economically optimum results, the magnet should preferably be so shaped that the convex curved lifting surface measured across the curve has a dimension of 1.5 to 2.5 times the maximum thickness of the slabs to be turned.

The curved lifting surface preferably has a central zone with a large radius or radii of curvature. This means that half-way through the turning action, when the slab has arrived at a vertical position, there is an effective electromagnetic coupling (with a small air gap) between the slab and the magnet. This is important when lifting the slab from this position on the ground and transporting it.

BRIEF DESCRIPTION OF DRAWINGS

A preferred embodiment of the invention will be described below by way of example with reference to the accompanying drawings, in which.

DESCRIPTION OF PREFERRED EMBODIMENT

Figures 1, 2, 3, 4, 5, 6, 7, 8, 9, 10, 11, 12:
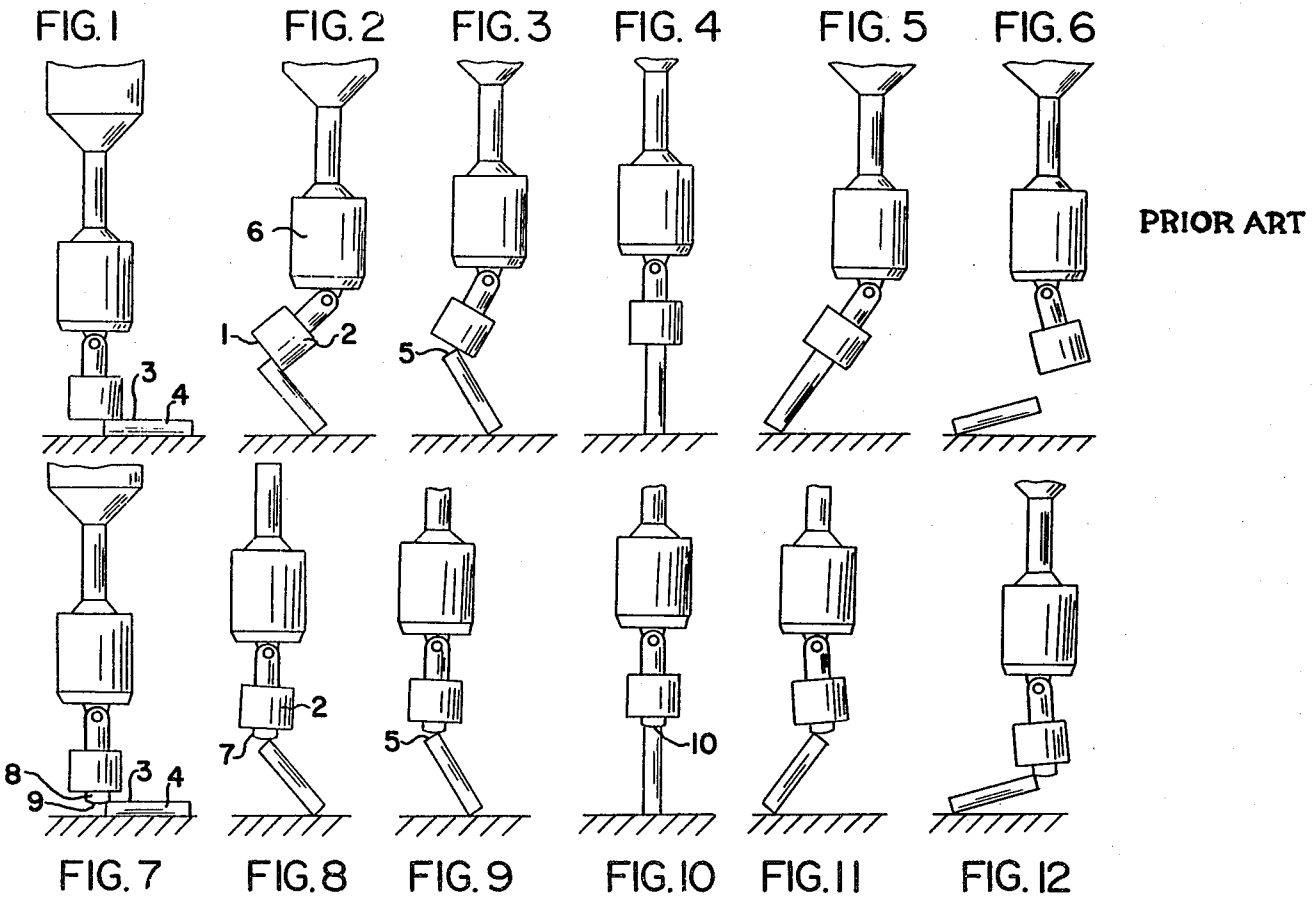
PRIOR ART FIG. 1
FIGS. 1 to 6 schematically show consecutive stages in the action of turning a slab by means of an electromagnet having a lifting surface in the conventional flat design.
FIGS. 7 to 12 show, also schematically, the stages corresponding to FIGS. 1 to 6, of turning of a slab, in this case with an electromagnet having a lifting surface of a single convex curved shape in accordance with the invention.

FIG. 1 shows the lifting undersurface 1 of an electromagnet 2 placed on the upper surface 3 of the slab 4. The electromagnet 2 is connected to the lifting yoke 6 of a crane not otherwise shown in the Figures. Expediently, as shown, the electromagnet 2 is hinged to the lifting yoke 6, enabling oscillatory movement of the electromagnet 2. After the electromagnet is activated and after a combined traversing (trolley) and lifting movement there is reached, via the situation shown in FIG. 2, the situation shown in FIG. 3 where the common contact surface between the lifting surface 1 of the electromagnet and the former upper surface 3 of the slab has been lost and contact consists temporarily of a line contact between the lifting surface of the electromagnet and the slab.

When the original contact surface between lifting surface 1 and the upper surface 3 is broken, the installation is jerked and there is a risk that the line contact does not occur, the slab falling to the ground and a disturbing noise being caused.

As the movement is continued, the situation in FIG. 4 is reached, with a new common contact surface between the underside 1 of the electro magnet and the lateral edge 5 of the surface.

On continuation of the movement, the situation in FIG. 5 is reached, after which it is intended that the slab should be put down under control. However, on continuation of the movement, the contact between the lifting surface of the electromagnet and the lateral side 5 of the slab is often broken and the slab falls to the ground, as drawn in FIG. 6. In this case, the installation is again subjected to a jerk and the disturbing noise described above again occurs.

In the design of the electromagnet in accordance with the invention however the undersurface 7 of the electromagnet is curved as seen in section transverse to its direction of elongation (i.e. it is curved as seen in the end view of FIGS. 7 to 12.) This undersurface is geometrically generated by moving the arc seen in FIG. 7 in the direction perpendicular to the plane of the paper. In use, there is continuous line contact from the start between this simple convex curved lifting surface 7 of the electromagnet 2 and the upper surface 3 of the slab 4, as drawn in FIGS. 7 to 12. For example, optimally, the undersurface may include a curved cylindrical surface which has its axis situated at the location of the axis of the hinge between the electromagnet 2 and the yoke 6. In view of the cylindrical undersurface, the 'line contact' between the slab 4 and the undersurface is slowly shifted because of a mutual surface rolling contact between the undersurface 7 and the slab thickness 5, whereby the 'line contact' is constantly maintained. The risk of the slab being dropped is thus avoided or much reduced. Disturbing noise as a result of the slab falling is minimized or avoided and the installation is not affected by jerking.

For this purpose, as shown in FIG. 7, the electromagnet may include a removable shoe 8, the undersurface 9 of which includes a single convex curved shape. As explained before, the curved shape at least partly comprises a cylindrical surface having its axis through the hinge of the electromagnet. Any other convenient curvature for the undersurface 7 may be chosen, depending on the design of the electromagnet and the thickness of the slabs to be handled. Expediently, as aforesaid, the undersurface should include an arcuate surface dimension of 1.5 to 2.5 times the maximum thickness of the slabs to be handled.

FIG. 10 shows the state where the slab 4 is vertical during turning. It sometimes happens that the slab has to be lifted from the ground in this situation and transported. To promote the most effective electro magnetic coupling in this position, the convex curved lifting surface 7 is designed with a large radius of curvature at a central region (as seen in FIGS. 7 to 12) on either side of the common contact line 10 between the lifting surface 7 and the lateral edge 5 of the slab. Adjacent the two lateral edges of the lifting surface, the radius of curvature is smaller than at this central region. Since, in practice, the line contact in the position in FIG. 10 is achieved around the centre region of the convex curved lifting surface, this means that the lifting surface is designed with a zone at its centre having large radius of curvature.

Within the scope and spirit of the invention, other shapes of the electromagnet are possible.

What is claimed is:

1. In electromagnetic apparatus for turning and/or lifting a slab of ferromagnetic material, comprising an electromagnet having an undersurface which is in contact with a face of the slab during use, and means for lifting and traversing the electromagnet, the improvement that the said undersurface of the electromagnet which in use is in contact with a face of the slab includes a convexly curved surface which geometrically is generated by linear displacement of a singly curved smooth kinkless arc made to move along a straight line perpendicular to a plane containing the arc.

2. Electromagnetic apparatus according to claim 1 wherein the electromagnetic has a removable shoe, the shoe having the said undersurface of convexly curved shape.

3. Electromagnetic apparatus according to claim 2 wherein the said surface of convexly curved shape includes, as seen in section, in said plane of said arc of generation, a central region between two side regions, the radius or radii of curvature of the central region being greater than the radius or radii of curvature of the side regions.

4. Electromagnetic apparatus for turning and/or lifting a slab of ferromagnetic material, comprising:

(a) an electromagnet having an undersurface which is intended to be in line-contact with a face of said slab in use, said undersurface including a convexly curved surface which geometrically is generated by displacement of a singly curved smooth kinkless arc moving along a straight line perpendicular to a plane containing the arc, and (b) hinged means for lifting and traversing the electromagnet while the electromagnet is at least partly lifting the slab through a line-contact engagement of said undersurface with the slab.

5. In a method of electromagnetically lifting and/or turning a slab of ferromagnetic material comprising the steps of contacting the slab with an undersurface of an electromagnet, lifting the slab by means of the electromagnet and traversing the electromagnet, the improvement that the said undersurface of the electromagnet includes a convexly curved shape which geometrically is generated by displacement of a singly curved smooth kinkless arc moving along a straight line perpendicular to a plane containing the arc, the method including the step of continuously maintaining a rolling line-contact between said undersurface of the electromagnet and an end surface of the slab, and shifting the line-contact during slab lifting or rolling.

6. A method according to claim 5 wherein the said undersurface of convexly curved shape has, as seen in section in said plane of said arc of generation, a central region between two side regions, the radius or radii of curvature of the central region being greater than the radius or radii of curvature of the side regions.

7. A method according to claim 6 wherein the width, along said arc of generation of said surface of the electromagnet is 1.5 to 2.5 times a thickness of the slab.

8. Electromagnetic apparatus for selectively turning and lifting a slab of ferromagnetic materials, comprising:

an electromagnet which has a main body which is hinged and is dependent from a substantially horizontal hinge, said main body having an undersurface which includes at least a segment of a substantially cylindrical convex surface having an axis which is substantially in a same plane with said horizontal hinge, and means for lifting and traversing the electromagnet body in use while the electromagnet is at least partly lifting the slab through a line-contact engagement of said undersurface with a face of the slab.

* * * * *